US006158336A

United States Patent [19]

Cambiano

[11] Patent Number: 6,158,336

[45] Date of Patent: Dec. 12, 2000

[54] TRASH COMPACTING CONTAINER INCLUDING GUIDE PLATE

[76] Inventor: Angelo M. Cambiano, 5908 N. Jackson Dr., Kansas City, Mo. 64119

[21] Appl. No.: 09/255,556

[22] Filed: Feb. 22, 1999

[51] Int. Cl.[7] ..... B30B 1/32; B30B 15/00

[52] U.S. Cl. ..... 100/345; 100/233

[58] Field of Search ..... 100/345, 233

[56] References Cited

U.S. PATENT DOCUMENTS

| | | | |
|---|---|---|---|
| 3,709,389 | 1/1973 | Steltz . | |
| 3,893,386 | 7/1975 | Wise | 100/233 |
| 3,903,461 | 9/1975 | Waggoner . | |
| 3,961,573 | 6/1976 | Schmidt . | |
| 4,070,962 | 1/1978 | Peterson . | |
| 4,152,979 | 5/1979 | Schmidt | 100/233 |
| 4,155,297 | 5/1979 | Smith et al. . | |
| 4,271,756 | 6/1981 | Bettencourt | 100/233 |
| 4,290,352 | 9/1981 | Schmidt et al. . | |
| 4,722,270 | 2/1988 | Wall . | |
| 5,324,161 | 6/1994 | Thobe . | |

FOREIGN PATENT DOCUMENTS

| | | | |
|---|---|---|---|
| 3443731 | 4/1986 | Germany | 100/233 |
| 1456436 | 11/1976 | United Kingdom | 100/233 |
| 1226908 | 3/1991 | United Kingdom | 100/233 |

OTHER PUBLICATIONS

Sales Literature of McClain Industries, Inc. of Utica, Michigan, for Front Loading Packer Boxes, FC–468, published in 1992.

Sales Literature of McClain Industries, Inc. of Utica, Michigan, for Magnum Vertical Packer M–V–P–4/6/8 published in 1994.

*Primary Examiner*—Stephen F. Gerrity

*Attorney, Agent, or Firm*—Shughart Thomson & Kilroy P.C.

[57] ABSTRACT

A compacting system including a double action vertical ram pivotally mounted within a container. The container includes a front wall, a rear wall, a pair of side walls, a floor and a lid. An opening in the front wall allows refuse or other material to be deposited into the container. A hingedly mounted door covers the opening. The ram includes a pivotally mounted compression plate and a cylinder mounted to one of the side walls with one end thereof mounted above said plate. A shaft extends from a housing of the cylinder and is attached within the container to the plate. In a compaction cycle, the compression plate can travel from a "vertical" position to a substantially "horizontal" position, and compacts the refuse between a lower surface of the compression plate and the floor. A power unit located outside the container provides power to actuate the cylinder. A magnetic safety switch and a door interlock device provide safety features for the compacting system.

17 Claims, 2 Drawing Sheets

Fig. 1.
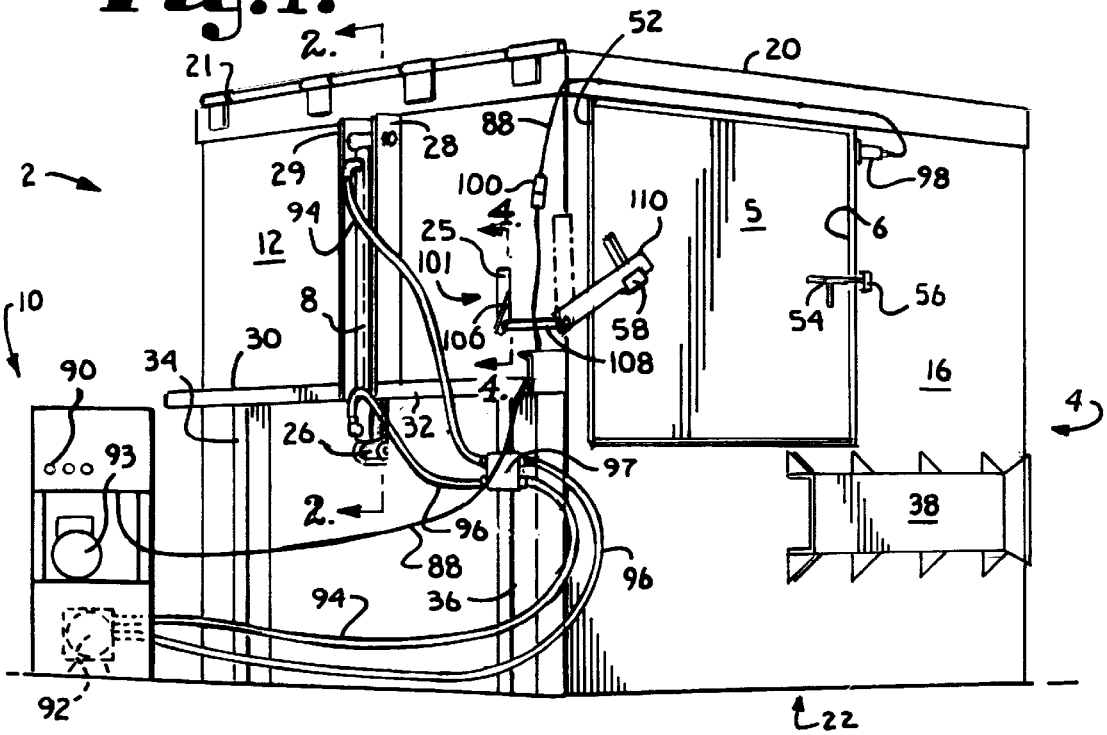
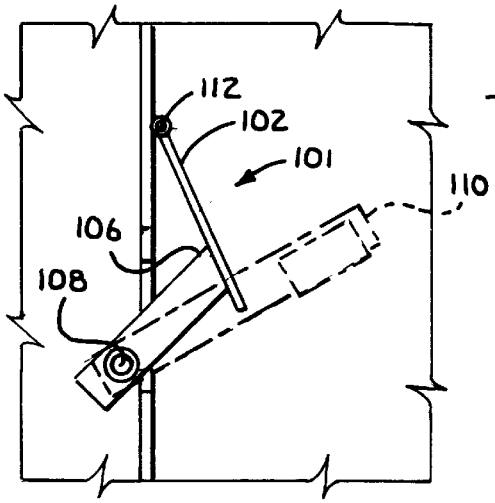
Fig. 4.

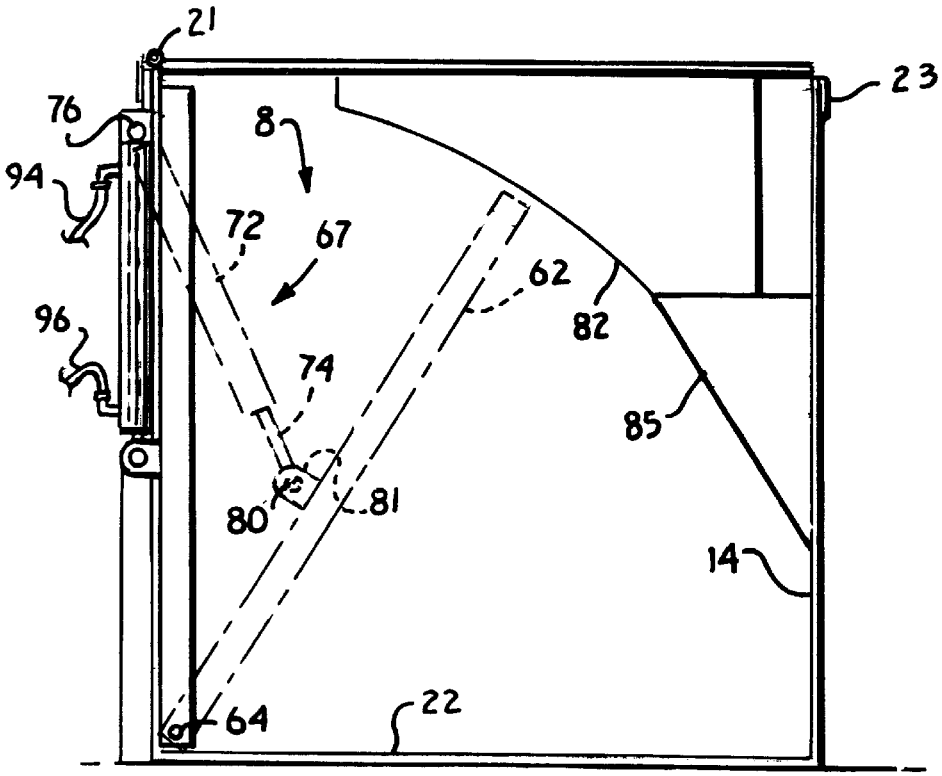
Fig. 2.
Fig. 3.
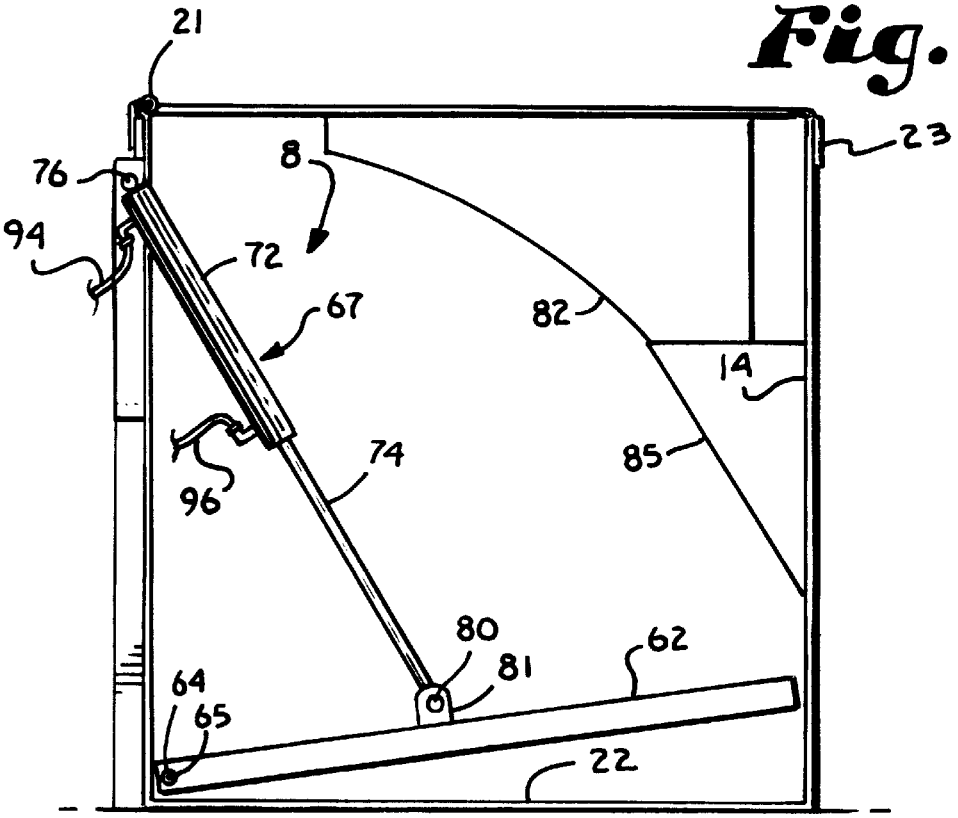

TRASH COMPACTING CONTAINER INCLUDING GUIDE PLATE

BACKGROUND OF THE INVENTION

1. Field of the Invention

The present invention relates generally to material and refuse handling and compacting containers, and in particular to a front-loading, invert to dump, vertical packing material handling container, including a self-contained compression plate with a cylinder mounted above the plate connected thereto, with the plate pivotally mounted within the container.

2. Description of the Related Art

Material and refuse handling is an ever increasing problem confronting today's society. Devices for storing and compacting refuse are not new. Prior devices include containers adapted to be periodically unloaded by inverting and dumping into a truck or other carrier for removal from a site. These devices are normally located near apartments, industrial plants, stores, or other places where large quantities of refuse accumulate. Some of the prior devices have compacting capabilities; others do not. Frequently, these devices are exposed to severe weather conditions including rain, snow, and ice, and their performance can be effected thereby.

The prior art includes the Waggoner U.S. Pat. No. 3,903,461 directed to Electrical Circuitry for Refuse Compactor. Although the Waggoner '461 patent discloses a packing head pivotally mounted within a container, the packing head of the '461 patent is of irregular shape and is mounted at the bottom of the container. A packing motor, a pump, valves and a hydraulic cylinder with a shaft are all located within the container. Unlike the present invention, the orientation of the cylinder in the '461 patent results in a relatively long shaft stroke, and increased power requirements.

The prior art also includes the Schmidt et al. U.S. Pat. No. 4,290,352, directed to a Refuse Bin Lid Unit. Although the Schmidt '352 patent discloses a packing blade adapted to be swung rearwardly in a chamber thereby compacting refuse, the compaction takes place between an outer surface of the blade and a rear wall of the container.

Other have designed different devices for similar purposes. However, such devices generally are more complicated in construction and, therefore, more expensive to manufacture and more difficult to use. Other devices are not weather proof and will not operate in sub-freezing conditions.

The present invention addresses the shortcomings of the previous compacting containers. Heretofore there has not been available a compactor with the advantages and features of the present invention.

SUMMARY OF THE INVENTION

The present invention generally comprises a compacting system including a container, a door covering an opening in a front wall, a double action hydraulic ram and a power unit. The container includes side walls, a front wall, a rear wall, a floor and a lid. A first opening and a relatively larger second opening are located in one of the side walls. Support members surround the second opening. The lid is hingedly connected to the container and is held in a closed position by a gravity release latch. Metal sleeves are welded to the front and rear wall in a position to engage lift arms of a truck.

The front wall's opening is formed in an upper corner thereof. Refuse may be placed in the container through the opening. Locating the opening in the upper corner tends to keep rodents or other animals from entering the container. A door is hingedly connected to the opening.

The ram includes a compression plate located entirely within the container, and a hydraulic cylinder with a housing and a shaft extending therefrom. The cylinder's housing is placed above the compression plate in the sidewall's first opening and is pivotally mounted to the adjacent support members. An end of the shaft is connected to the compression plate. During a compression cycle, the plate travels downward and in an arc from a substantially vertical position to a substantially horizontal position as the shaft travels from a retracted position to an extended position. In cold or other adverse weather, the plate will not readily freeze because it is normally in its vertical position, where water tends to run off the plate rather than collect thereon.

The power unit includes an electric switch, and a pump with a motor. The pump supplies working fluid through a hose to actuate the cylinder. A magnetic safety switch is mounted adjacent the door and ensures the compacting system will not operate unless the door is in a closed position. Another safety feature, an interlock device, ensures that the door can only be opened when the compression plate is in its vertical position.

OBJECTS AND ADVANTAGES OF THE INVENTION

The present invention provides, as an important object, a compacting device with a compression plate which will compact refuse to reduce the frequency of pickup of said refuse; to provide such a device including a self-contained vertical ram pivotally mounted within a container and above the plate; to provide such a device with a ram with a relatively short cycle time and short stroke; to provide such a device including a cylinder mounted at one end thereof above said plate; to provide such a device that can be operated in adverse weather conditions including rain, snow or ice; to provide such a device that is fire proof; to provide such a device which is rodent proof; to provide such a device with a front loading opening and a door covering said opening; to provide such a device with a safety switch such that the device will not operate unless the door is in a closed position; to provide such a device with a safety feature such that the door can not be opened unless the plate is in a vertical position; to provide such a device which requires minimal power for operation; to provide such a device which is relatively simple to manufacture; and to provide such a device which is particularly well adapted for the intended usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of the compacting system embodying the present invention.

FIG. 2 is a sectional view showing a cylinder thereof with a shaft attached to a compression plate, the shaft in a retracted position and the compression plate being shown in a vertical position in solid lines, and in a semi-extended position in phantom lines.

FIG. 3 is a sectional view showing the cylinder with the shaft attached to the compression plate, the shaft being in a fully-extended position.

FIG. 4 is a sectional view showing an interlocking device of the compacting system with an arm of the device shown in a locking position in phantom lines.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Referring to FIG. 1 in greater detail, the reference numeral 2 generally refers to the compacting system of the present invention. The compacting system 2 generally comprises a container housing 4, a door 5 covering an opening 6, a double action hydraulic ram 8, and a ram power unit 10.

II. Container 4

The container 4 is assembled by joining together (for example, by welding) a plurality of components primarily made from carbon steel or other metal. The container 4 comprises two side walls 12 and 14 which are connected at one end by a front wall 16 and at the opposite end thereof by a rear wall (not shown). A lid 20 is secured by a hinging device 21 to an upper edge of the side wall 12. In a closed position, the lid 20 lies on upper edges of the sidewalls 12 and 14, the front wall 16 and the rear wall, respectively. Respective lower edges of the walls 12, 14 and 16 are joined by a bottom or floor 22. A gravity release latch 23 secures the lid 20 in a closed position.

The side wall 12 contains a first slit or opening 25, and a relatively larger second slit or opening 26, the functions of which will be discussed later in greater detail. Vertical support members 28 and 29 are positioned normal to respective opposite vertical edges of the slit 26 on the side wall's 12 outer surface and are welded thereto. Respective first and second horizontal support members 30 and 32 are positioned with a respective end normal to and abutting the vertical support members 28 and 29 and extend respectively over the side wall's 12 outer surface toward the front wall 16 and rear wall. The support members 30 and 32 are welded along the abutted areas and to the side wall's 12 outer surface. First 34 and second 36 vertical support beams are positioned with a respective end normal to and abutting the horizontal support members 30, 32 and extend downward toward the floor 22. The vertical support beams 34 and 36 are welded along the respective abutted areas to the horizontal members 30 and 32, and to the side wall's 12 outer surface.

Metal sleeves 38 are welded to the respective outer surfaces of the front wall 16 and the rear wall in positions to engage the forwardly projecting lift arms of a truck or other refuse collection vehicle, as discussed more below.

III. Opening 6

The opening 6 is formed in an upper corner of the front wall 16 and is sized to allow refuse material to be easily deposited into the container 4. The door 5 is sized to cover the opening 6 and is attached at a vertical edge thereof by a hinging device 52 such that the door 5 may be opened and closed by pivoting about the hinging device 52. A latch 54 is welded to an outer surface of the door 5. When the door 5 is in a closed position, the latch 54 may be inserted into a receiver 56 welded to the front wall's 16 outer surface to secure the door 5 thereto. A receiving bracket 58, the function of which will be discussed later, is welded to the door's 5 outer surface.

IV. Ram 8

Referring to FIGS. 2 and 3, the vertical ram 8 includes a compression plate 62 located entirely within the container 4. A cylindrical shaft or rod 64 with opposite ends is attached by any suitable means (e.g. welding) to a lower edge of the plate 62. The rod 64 is slightly longer than the lower edge of the plate 62. The ends of the rod 64 are inserted into a pair of receivers 65 mounted near respective lower corners of inner surfaces of the front wall 16 and the rear wall 18. The plate 62 may be pivoted in an arc about the rod 64, as discussed more below.

A hydraulic cylinder 67 including a housing 72 and a cylindrical shaft 74 is mounted by any suitable means, such as a pin assembly 76, to the vertical support members 28 and 29. The cylinder 67 is positioned within the side wall's opening 26. An end of the shaft 74 is attached by any suitable means, such as a pin assembly 80, to a fastener 81 mounted (e.g. welded) to a rear surface of the plate 62.

A curved refuse guide plate 82 is attached by any suitable means (e.g. welding) at an end thereof to the lid 20, and extends downward and across the length of the sidewall 14. The guide plate 82 is generally outwardly curved and closely follows the path of a distal end of the compression plate 62. Similarly, a lower refuse guide plate 85 is attached by any suitable means (e.g. welding) to the side wall 14 and extends the length thereof. The lower guide plate 85 also closely follows the path of a distal end of the compression plate 62. In operation, the guide plates 82 and 83 ensure refuse being compacted does not "escape" onto the upper surface of the compression plate 62.

By actuating the cylinder 67 (as discussed below), the shaft 74 can travel from a "retracted" position where a majority of the shaft 74 is located within the housing 72, to an "extended" position where the shaft 74 extends telescopically away from the housing 72. The orientation of the cylinder 67 above the plate 62 results in a relatively short shaft 74 stroke. When the shaft 74 is in the retracted position, the plate 62 is in a substantially vertical position proximate the side wall 12. When the shaft 74 is in the extended position, the plate 62 is in a substantially horizontal position proximate the floor 22.

V. Power Unit 10

The ram power unit 10 includes a two-piece power cord 88, an electric switch 90 and a hydraulic pump 92 with a motor 93. A two-piece supply hose 94 and a two-piece return hose 96 are connected between the pump 92 and the cylinder 67. A connection plate 97 is mounted to the sidewall's 12 outer surface intermediate the pump and the cylinder where respective ends of the supply hoses 94, 96 are removably connected thereto.

A magnetic safety switch 98 is mounted to the front wall's 16 outer surface adjacent the door 5. An interface plug 100 removably connects the two lengths of the electrical cord 88 intermediate the magnetic switch 98 and the power unit 10. The safety switch 98 ensures that the electric switch 90 will not supply power to the motor 93 unless the door 5 is in a closed position.

Referring to FIG. 4, a door interlock device 101 provides an additional safety device. As discussed more below, the interlock device 101 ensures that the door 5 can be opened only when the compression plate 62 is in the substantially vertical position. The interlock device 101 includes a metal contact plate 102 having a front surface and a rear surface, and opposite ends. A first arm 106 is attached by any suitable means, such as welding, to the plate's 102 rear surface and forms an obtuse angle with the rear surface. A cylindrical shaft 108 attached normal to the arm 106 extends forward therefrom where a second arm 110 is attached by any suitable means such as welding. The arm 110 extends for a length in a direction generally opposite that of the first arm 106.

The interlock device 101 is attached to the container 4 as follows. The first end of the contact plate 102 is mounted by any suitable means, such as a pin connector 112, to the side wall's 12 inner surface near the opening 25 such that the opposite free end of the plate 102 is free to move in an arc to and from the sidewall 12. In this position, the first arm 106 extends through the opening 25, the shaft extends forward toward the front wall 16 and the second arm 110 extends at an angle toward the an inner edge of the door 5. The second arm 110 travels between two positions; a first or free position where a far distal end of the arm 110 is in a vertical position, and a second or locked position where the arm's 106 distal end extends beyond the door's 5 inner edge and engages the door's receiving bracket 58. The arm is in the free position when the plate 62 is in its substantially vertical or fill position, engaging the contact plate 102. The arm 110 is in the locked position when the plate 62 ceases to engage the contact plate 102 when the cylinder 67 is actuated.

VI. Operation

Refuse or other material may be deposited into the container 4 through the opening 6 with the door 5 open and the plate 62 is in the substantially vertical position. When sufficient material has been deposited, it may be compressed by operating the compacting system 2. The power unit 10 may be activated by turning on the switch 90. The pump 92 will then supply working fluid via hoses 94 and 96 to actuate the cylinder 67. As fluid fills the cylinder's housing 72, the shaft 74 is extended, moving the plate 62 downward and in an arc from its substantially vertical position to its substantially horizontal position, compressing or compacting the material between the plate 62 and the floor 22.

Due to the shaft's 74 short stroke, power requirements are minimal. For example, the present embodiment utilizes a 1 hp, 120V single phase motor driving a 1 gal./min. pump. The present embodiment is designed for an approximate 70 second cycle time.

This cycle may be repeated until the container 4 is full. The present embodiment has a compaction ratio approximately 3:1. The container 4 can be dumped or emptied by first disconnecting the hoses 94 and 96 at the connection plate 97, and disconnecting the cord 88 at the interface plug 100. The container 4 may then be picked up by a truck's lifting arms which engages the sleeves 38 and inverts the container 4. Once inverted, the gravity release latch 23 automatically allows the lid 20 to swing open and the material falls out of the container 4 by gravity. The container can then be returned to the ground where the hoses 94 and 96 together with the cord 88 are reconnected. The compacting system 2 is then ready to repeat the cycle.

It is to be understood that while certain forms of the present invention have been illustrated and described herein, it is not to be limited to the specific forms or arrangement of parts described and shown.

What is claimed and desired to be secured by Letters Patent is as follows:

1. A trash compactor, comprising:

a) a trash container housing with a front, a rear and a pair of side walls interconnected by a floor;

b) a compression plate positioned within said housing, said compression plate being pivotally attached to said housing near a junction of a first of said side walls and said floor such that it is pivotable in an arc from a retracted, substantially vertical position proximate said first side wall to an extended position in which it is nearly parallel to said floor;

c) a double action hydraulic ram with a first end pivotally attached to said first side wall and with a second end pivotally attached to said compression plate such that extension of said ram moves said compression plate from said retracted to said extended position;

d) a lid covering said container;

e) a first refuse guide plate attached to the lid and extending between the front wall and the rear wall;

f) a second refuse guide plate attached to a second of said side walls and extending between the front wall and the rear wall; and g) said first and second guide plates collectively forming a shape which closely follows the path of a distal end of the compression plate as the plate moves from its retracted position to its extended position.

2. The trash compactor of claim 1, further comprising:

a) a power unit;

b) a door covering an opening in one of said walls for receiving refuse; and c) a safety switch connected to said door and to said power unit of said compactor whereby no power will be supplied to actuate the ram unless the door is in a closed position.

3. The trash compactor of claim 1, and further comprising:

a) a door covering an opening in one of said walls for receiving refuse; and b) an interlock device connected to said housing whereby the door can only be opened when the plate is in its substantially vertical position.

4. The trash compactor of claim 3, wherein the interlock device includes:

a) a contact plate mounted to an inner surface of one wall with an arm extending therefrom toward the door; and b) said arm is movable from a position securing the door when the compression plate engages the contact plate, to a vertical position allowing the door to be opened when the compression plate does not engage the contact plate.

5. The trash compactor of claim 1, wherein said lid is attached at an end thereof by a hinging device to the container and secured thereto in a normally closed position by a gravity release lock.

6. The trash compactor of claim 1, further comprising:

a) a ram power unit; and b) a pair of hoses connected to said power unit and removably connected to said hydraulic ram.

7. The trash compactor of claim 1, further comprising:

a) a pair of sleeves attached to outer surfaces of said housing, said sleeves being adapted to engage the forwardly projecting lift arms of a truck; and b) said lid is hinged to open in an inverted position to permit refuse to drop from the housing.

8. The trash compactor of claim 1, wherein the compactor is constructed of carbon steel.

9. A trash compacting device comprising:

a) a trash container housing with a front, a rear, a pair of side walls interconnected by a floor and a lid hinged at its rear edge to an upper edge of a first of said side walls;

b) an opening in the front wall with a door covering said opening;

c) an opening in a first of said side walls and a plurality of support members adjacent the opening and mounted to said first side wall;

d) a compression plate positioned within said housing, said compression plate being pivotally attached to said housing near a junction of said first side wall and said floor such that it is pivotable in an arc from a retracted, substantially vertical position proximate said first side wall to an extended position in which it is nearly parallel to said floor;

e) a double action hydraulic ram positioned in the first side wall's opening and with a first end pivotally attached to the support members and with a second end pivotally attached to said compression plate such that extension of said ram moves said compression plate from said retracted to said extended position;

f) a plurality of guide plates attached to the container, said guide plates having a shape which follows the path of a distal end of the compression plate as the plate moves from its retracted position to its extended position; and g) a ram power unit including a motor and a pump for actuating said hydraulic ram.

10. The trash compactor of claim 9, and further comprising a safety switch connected to said door and to said power unit of said compactor whereby no power will be supplied to actuate the ram unless the door is in a closed position.

11. The trash compactor of claim 9, and further comprising an interlock device connected to said housing whereby the door can only be opened when the plate is in its substantially vertical position.

12. The trash compactor of claim 11, wherein the interlock device includes:

a) a contact plate mounted to an inner surface of one wall with an arm extending therefrom toward the door; and b) said arm movable from a position securing the door when the compression plate engages the contact plate, to a vertical position allowing the door to be opened when the compression plate does not engage the contact plate.

13. The trash compactor of claim 9, wherein said lid is attached at an end thereof by a hinging device to the container and is secured thereto in a normally closed position by a gravity release lock.

14. The trash compactor of claim 9, wherein said plurality of guide plates comprise:

a) a first refuse guide plate attached to the lid and extending between the front wall and the rear wall; and b) a second refuse guide plate attached to one said side wall and extending between the front wall and the rear wall, said first and second guide plates cooperating to form said shape which closely follows the path of a distal end of the compression plate as the plate moves from its retracted position to its extended position.

15. The trash compactor of claim 9, further comprising a pair of hoses connected to said power unit and removably connected to said hydraulic ram.

16. The trash compactor of claim 9, and further comprising a pair of sleeves attached to outer surfaces of said housing, said sleeves being adapted to engage forwardly projecting lift arms of a truck.

17. A trash compactor apparatus comprising:

a) a trash container housing including a plurality of upstanding side walls interconnected by a floor;

b) a compression plate pivotally connected at a lower connection end thereof to a side wall of said container within said container and pivotable between a retracted position adjacent a selected one of said side walls and a compacting position toward said floor, said compression plate having an outer end spaced from said connection end;

c) a compactor motor engaged between said housing and said compression plate and operable to move said compression plate between said retracted position and said compacting position;

d) a container lid pivotally connected to one of said side walls at a location spaced from said floor; and e) a trash guide plate assembly extending across said housing and having a first portion connected to at least one of said side walls and a second portion connected to said lid, said guide plate assembly being shaped and positioned to be in close proximity to said outer end of said compression plate during movement of said compression plate, and said guide plate assembly cooperating with said compression plate to facilitate compacting trash within said container by said compression plate.

* * * * *